US005795844A

United States Patent [19]

Evans et al.

[11] Patent Number: 5,795,844

[45] Date of Patent: Aug. 18, 1998

[54] DYE SETS FOR THERMAL IMAGING HAVING IMPROVED COLOR GAMUT

[75] Inventors: Steven Evans, Rochester; Daniel J. Harrison, Pittsford; Elizabeth McInerney, Rochester; Kevin E. Spaulding, Spencerport; Helmut Weber, Webster, all of N.Y.

[73] Assignee: Eastman Kodak Company, Rochester, N.Y.

[21] Appl. No.: 808,289

[22] Filed: Feb. 28, 1997

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 4,923,846 5/1990 Kutsukake et al. ..... 503/227

5,514,637 5/1996 Lum et al. ..... 503/227

*Primary Examiner*—Bruce H. Hess

*Attorney, Agent, or Firm*—Harold E. Cole

[57] ABSTRACT

A multicolor dye-donor element for thermal dye transfer capable of producing improved color gamut comprising a support having thereon a set of sequential repeating dye patches of yellow, magenta and cyan image dyes dispersed in a polymeric binder, the element also having at least one additional dye patch comprising a dye dispersed in a polymeric binder, the dye of each such additional dye patch which, when transferred to a dye image-receiving layer before or after transfer of the original yellow, magenta and cyan image dyes, has a hue measured at its maximum density which is outside the color gamut defined by the hues of the original transferred yellow, magenta and cyan image dyes by more than 5 CIELAB $\Delta E_c$ units.

13 Claims, 4 Drawing Sheets

DYE SETS FOR THERMAL IMAGING HAVING IMPROVED COLOR GAMUT

FIELD OF THE INVENTION

This invention relates to a means for improving or enlarging the color gamut of a thermal dye transfer imaging system.

1. Background of the Invention

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

The color gamut of an image display medium defines the range of colors which can be produced by that medium. It is desirable for the color gamut to be as large as possible. The so-called CIELAB color coordinates a*, b*, and L*, when specified in combination, describe the color of an object (under given or known viewing conditions), whether it be red, green, blue, etc. The measurement of a*, b*, and L* is well documented and now represents an international standard of color measurement. The well known CIE system of color measurement was established by the International Commission on Illumination in 1931 and was further revised in 1971. For a more complete description of color measurement refer to "Principles of Color Technology", 2nd edition by F. Billmeyer, Jr. and M. Saltzman, published by J. Wiley and Sons, New York, 1981.

The production of full color reflection prints or transparencies via thermal dye transfer imaging involves the sequential transfer of three subtractive-primary color records (cyan, magenta and yellow) from dye-donor sheets or ribbons to a receiver element. Optionally a fourth, black dye donor may also be employed which is normally a balanced mixture of the subtractive-primaries. Each subtractive-primary dye-donor may contain one or more dyes chosen to provide optimum heat and light stability, transferability and hue.

The spectra herein are considered to be yellow if they have a maximum absorbance between 400 and 500 nm, magenta if they have a maximum between 500 and 580 nm, and cyan if they have a maximum between 580 and 700 nm.

The range of colors that can be reproduced with a given set of subtractive-primary dyes is known as the color gamut. The color gamut of the imaging system is controlled primarily by the spectral density distributions of the transferred dyes. Other characteristics which can affect color gamut to a lesser extent are the D-min of the receiver base, the D-max of each dye, the amount of light scatter, and the spectral distribution of the viewing illuminant. The choice of dyes is critical in maximizing the color gamut of a thermal dye transfer imaging system.

2. Description of Related Art

There are several ways in which the color gamut of a thermal dye transfer system might be increased. One could increase the maximum amount of each of the subtractive-primary dyes that can be transferred—by using more readily-diffusible dyes or dyes with higher extinction coefficients, for example. This approach is limited by the nature of the thermal dye transfer materials and processes and would only result in relatively small gamut increases as will be shown below.

A fourth, black dye-donor, which is usually a balanced mixture of the three subtractive-primary dyes, may also be used along with the three subtractive-primary dye-donors. This would be equivalent to adding more subtractive-primary dyes and, again, will only have a relatively slight effect on overall color gamut as will be shown below.

U.S. Pat. No. 5,514,637 discloses that a dye-donor element employed in thermal dye transfer imaging may have alternating areas of different dyes such as cyan, magenta, yellow, black or other dyes, so that one-, two-, three-,or four-color elements (or higher numbers also) may be employed. However, there is no disclosure in this patent how to select such other dyes so as to increase the color gamut of the subtractive-primary 3-color dye set.

U.S. Pat. No. 4,923,846 relates to the selection of a set of three subtractive-primary dyes (cyan, magenta and yellow) for thermal dye transfer imaging for improved color reproduction or color gamut. Dye selection criteria are derived from a relatively crude analysis of the dyes'absorption characteristics. U.S. Pat. No. 4,812,439 also describes the selection of a set of three subtractive-primary dyes (cyan, magenta and yellow) for thermal dye transfer imaging, but the criteria merely involve a more precise mathematical description of the dyes' absorption characteristics.

There is a problem with the dye selection in these prior art patents in that the color gamut of the dye set chosen is not as large as one would like it to be.

It is an object of this invention to provide a dye-donor element for thermal dye transfer having an increased or improved color gamut.

SUMMARY OF THE INVENTION

This and other objects are achieved in accordance with this invention which relates to a multicolor dye-donor element for thermal dye transfer capable of producing improved color gamut comprising a support having thereon a set of sequential repeating dye patches of yellow, magenta and cyan image dyes dispersed in a polymeric binder, the element also having at least one additional dye patch comprising a dye dispersed in a polymeric binder, the dye of each such additional dye patch which, when transferred to a dye image-receiving layer before or after transfer of the original yellow, magenta and cyan image dyes, has a hue measured at its maximum density which is outside the color gamut defined by the hues of the original transferred yellow, magenta and cyan image dyes by more than 5 CIELAB $\Delta E_c$ units.

DESCRIPTION OF THE PREFERRED EMBODIMENTS

Figure 1:
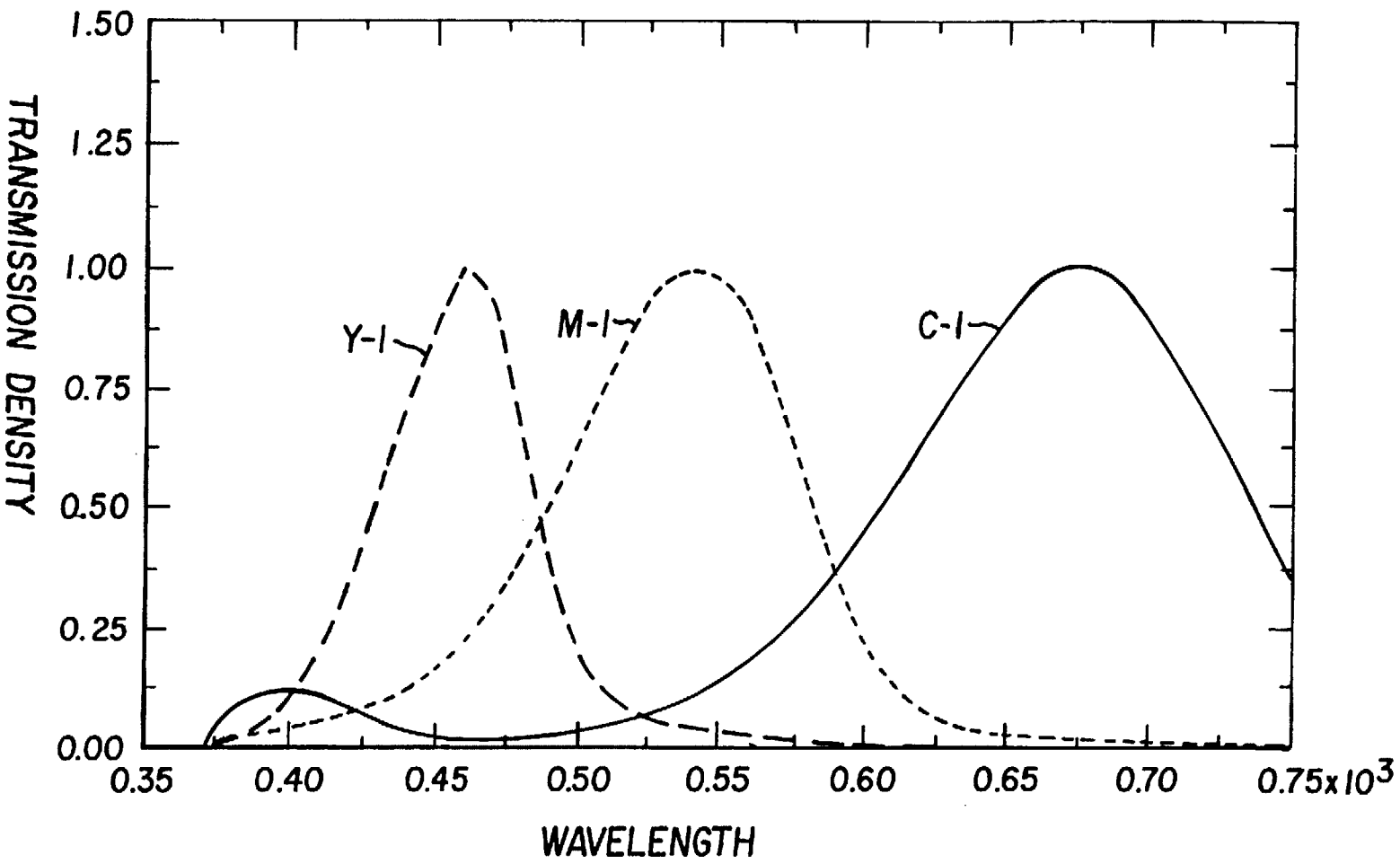
FIG. 1 is a plot of normalized spectral transmission density vs. wavelength of transferred yellow, magenta and cyan image dyes for a Dye Set A.

When the CIELAB color coordinates (L*, a*, b*) of the transferred image of an additional spectrally independent image dye determined at D-max are outside of the color gamut defined by the basis dye set by more than 5 $\Delta E_c$ units, large increases in color gamut will be obtained. In general, the larger the value of $\Delta E_c$, the larger will be the increase in color gamut. In a preferred embodiment of the invention, the CIELAB color coordinates of the transferred image of the additional spectrally independent image dye determined at D-max are outside of the color gamut defined by the basis dye set by more than 10 $\Delta E_c$ units.

In another preferred embodiment of the invention, the set of sequential repeating dye patches contains an additional dye patch comprising a black image dye dispersed in a polymeric binder.

The color gamut increase of the invention can be represented mathematically as:

$$\Delta E_c=(c^*_1-c^*_2)\geqq 5 \text{ assuming } L^*_1=L^*_2 \text{ (equal lightness)}$$

where $c^*=\sqrt{(a^*)^2+(b^*)^2}$, subscript 1 refers to the transferred image of the additional image dye and subscript 2 refers to the transferred image of the closest (in CIELAB space) linear combination of the basis dye set respectively. The point of closest approach of the basis dye set gamut to the color coordinates of the additional image dye may be determined by inspection of color space plots or by an iterative calculation of $\Delta E_c$ along the gamut boundary.

For the purpose of this invention, color gamut is specified in the CIELAB metric. Color gamut is defined as the sum of the a*–b* areas of 9 L* slices (L*=10, 20, 30, 40, 50, 60, 70, 80 and 90) obtained when a given dye set is used. Color gamut may be obtained through measurement and estimation from a large sample of color patches which is very tedious and time-consuming, or it may be calculated from the measured absorption characteristics of the individual dyes using the techniques described in J. Photographic Science, 38, 163 (1990).

The absorption characteristics of a given image dye will vary to some extent with a change in the amount of dye transferred. This is due to factors such as measurement flare, dye-dye interactions, dye-receiver interactions, dye concentration effects, and the presence of colored impurities in the media. However, by using characteristic vector analysis, sometimes referred to as principal component analysis or eigenvector analysis, one can determine a characteristic absorption curve that is representative of the absorption characteristics of the dye over the complete wavelength and density ranges of interest. This technique is described by J. L. Simonds in the Journal of the Optical Society of America, 53 (8), 968–974 (1963).

The characteristic vector of a given dye is a two-dimensional array of transmission density and wavelength normalized to a peak height of 1.0. The characteristic vector is obtained by first measuring the reflection spectra of test images comprising patches of varying densities including D-min and D-max. The spectral reflection density of the D-min is then subtracted from the spectral reflection density of each color patch. The resulting D-min subtracted reflection densities are then converted to transmission density by passing the density data through the DR/DT (reflection/transmission) conversion transform. Characteristic vector analysis is then used to find one normalized spectral transmission density curve for each colorant which, when appropriately scaled in transmission density space, converted to reflection density, and added to D-min, gives the best fit to the measured spectral reflectance data over the entire density range.

Black mixtures described below are defined as being composed of the appropriate yellow, magenta and cyan subtractive-primary dyes combined in amounts such that a visually neutral image (a*=b*=0) results at D-max (a transferred reflection density of 2.5 measured at the highest peak in the composite absorption spectrum).

Color gamuts described herein are obtained by the calculation method, assuming Kodak Xtralife ® dye receiver, no light scatter, and a D5000 viewing illuminant (CIE "D" illuminant with a color temperature of 5000 Kelvin.

See "Principles of Color Technology", 2nd edition by F. Billmeyer, Jr. and M. Saltzman, published by J. Wiley and Sons, New York, 1981.) Additionally, the D-max for each dye is defined as that dye amount which will produce a maximum transferred reflection density of 2.5 at its peak absorption wavelength when transferred into Kodak Xtralife® dye receiver. However, the same relative results are found if color gamuts are obtained by a different method, with different assumed values for D-min, light scatter, viewing illuminant, and D-max, or through measurement and estimation of a large number of color patches.

Another measure of the ability of a given dye set to reproduce a wide variety of colors is to count the number of standard colors that can be reproduced. One popular compendium of standard colors useful in the graphic arts field is the Pantone® Color Formulation Guidebook published by Pantone Inc. of Moonachie N.J., U.S.A.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207, a polycarbonate, poly(styrene-co-acrylonitrile), a polysulfone or a poly (phenylene oxide). The binder may be used at a coverage of from about 0.1 to about 5 g/m$^2$.

The dye layer of the dye-donor element of the invention may be coated on the support or printed thereon by a printing technique such as a gravure process.

Any material can be used as the support for the dye-donor element of the invention provided it is dimensionally stable and can withstand the heat of the thermal printing head. Such materials include polyesters such as poly(ethylene terephthalate) and poly(ethylene naphthalate); polysulfones; polyamides; polycarbonates; glassine paper; condenser paper; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyamides such as polyimideamides and polyetherimides. The support generally has a thickness of from about 2 to about 30 μm. It may also be coated with a subbing layer, if desired, such as those materials described in U.S. Pat. Nos. 4,695,288 and 4,737,486.

The reverse side of the dye-donor element of the invention may be coated with a slipping layer to prevent the printing head from sticking to the dye-donor element. Such a slipping layer would comprise a lubricating material such as a surface-active agent, a liquid lubricant, a solid lubricant or mixtures thereof, with or without a polymeric binder. Preferred lubricating materials include oils or semicrystalline organic solids that melt below 100° C. such as poly (vinyl stearate), beeswax, perfluorinated alkyl ester polyethers, polycaprolactone, silicone oil, polytetrafluoroethylene, carbowax, poly(ethylene glycols), or any of those materials disclosed in U.S. Pat. Nos. 4,717,711; 4,717,712; 4,737,485; 4,738,950; 4,829,050; 5,234,889; 5,252,534; and U.S. patent application Ser. No. 08/633,238 of Bailey et al., filed Apr. 16, 1996. Suitable polymeric binders for the slipping layer include poly(vinyl alcohol-co-butyral), poly(vinyl alcohol-co-acetal), polystyrene, poly (vinyl acetate), cellulose acetate butyrate, cellulose acetate propionate, cellulose acetate or ethyl cellulose.

A dye-receiving element is used with the dye-donor element of the invention. The dye-receiving element comprises a support having thereon a dye image-receiving layer. The support may be a transparent film such as a poly(ether sulfone), a polyimide, a cellulose ester such as cellulose acetate, a poly(vinyl alcohol-co-acetal) or poly(ethylene terephthalate). The support for the dye-receiving element may also be reflective such as baryta-coated paper, polyethylenecoated paper, white polyester (polyester with a white pigment incorporated therein), an ivory paper, a condenser paper, a synthetic paper such as DuPont Tyvek®, or a microvoided-packing film laminated to a paper support as described in U.S. Pat. No. 5,244,861.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, a dye-donor element is used to form a dye transfer image. Such a process comprises imagewise-heating a dye-donor element as described above and transferring a dye image to a dye image-receiving layer of a dye-receiving element to form said dye transfer image. In another embodiment of the invention, a process of forming a dye transfer image is provided wherein separate dye-donor elements are employed comprising supports having thereon yellow, magenta, cyan image dye layers and at least one additional dye layer comprising an image dye dispersed in a polymeric binder, having the properties as described above.

Dyes useful in the dye-donor element of the invention are disclosed in U.S. Pat. Nos. 4,541,830; 4,698,651; 4,695,287; 4,701,439; 4,757,046; 4,743,582; 4,769,360; and 4,753,922; the disclosures of which are hereby incorporated by reference. The above dyes may be employed singly or in combination. The dyes may be used at a coverage of from about 0.05 to about 1 g/m$^2$ and are preferably hydrophobic.

Thermal printing heads which can be used to transfer dye from dye-donor elements employed in the invention are available commercially. There can be employed, for example, a Fujitsu Thermal Head (FTP-A040MCSOO1), a TDK Thermal Head F415 HH7-1089 or a Rohm Thermal Head KE 2008-F3.

A thermal dye transfer assemblage of the invention comprises:

(a) a dye-donor element as described above, and (b) a dye-receiving element as described above, the dye-receiving element being in a superposed relationship with the dye-donor element so that the dye layer of the donor element is in contact with the dye image-receiving layer of the receiving element.

When a multicolor image is to be obtained, the above assemblage is formed on various occasions during the time when heat is applied by the thermal printing head. After the first dye is transferred, the elements are peeled apart. Another area of the donor element with a different dye area is then brought in register with the dye-receiving element and the process repeated. The other colors are obtained in the same manner.

The following examples are provided to illustrate the invention.

EXAMPLE 1

The following dyes and dye sets were employed in the examples below:

a) Dye Set A—commercially available Kodak Xtralife® thermal printing media (image dye-donors designated as Y-1, M-1 and C-1).

b) Dye Set B—(image dyes Y-2, M-2 and C-2, see structures below) described in U.S. Pat. No. 4,812,439 as being preferred for large color gamut.

c) Dye Set C—Dye Set A plus a black donor (B-1) made from a balanced mixture of Y-1, M-1 and C-1 as described above.

d) Dye Set D—Dye Set B plus a black donor (B-2) made from a balanced mixture of Y-2, M-2 and C-2 as described above.

Image Dyes from U.S. Pat. No. 4,812,439

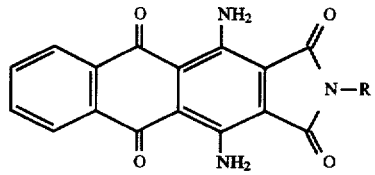

Cyan Dye C-2
"Kayaset B-766", Disperse Blue 60
R = $C_3H_6OCH_3$ or $C_2H_5OCH_3$

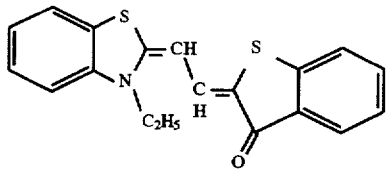

Magenta Dye M-2
"NK-1584"

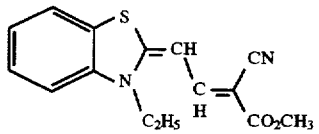

Yellow Dye Y-2
"NK-1581"

The following dyes represent additional, spectrally independent image dyes which can be used in addition to the above basis dye sets to increase color gamut.

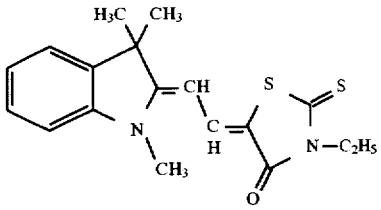

Dye P-1
λ max = 496 nm (acetone)

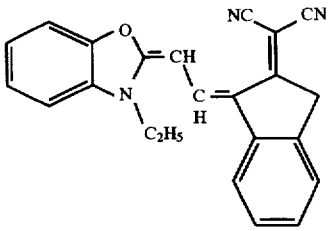

Dye P-2
λ max = 571 nm (acetone)

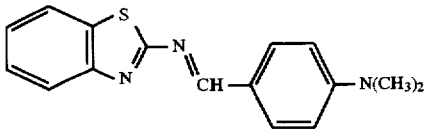

Dye P-3
"GY-9" from U.S. Pat. No. 4,812,439
λ max = 410 nm (acetone)

Preparation of Dye-Donor Elements

The Kodak Xtralife® dye-donors were commercially available. Other, individual dye-donor elements were prepared by coating on a 6 μm poly(ethylene terephthalate) support:

1) a subbing layer of Tyzor TBT®, a titanium tetrabutoxide, (DuPont Company) (0.16 g/m$^2$) coated from 1-butanol; and 2) a dye layer containing the dyes of the invention and control dyes described above, and FC-431® fluorocarbon surfactant (3M Company) (0.01 g/m$^2$) in a cellulose acetate propionate binder (2.5% acetyl, 45% propionyl) coated from a toluene, methanol and cyclopentanone mixture. Details of dye and binder laydowns are shown in Table 1.

On the back side of the dye-donor element were coated:

1) a subbing layer of Tyzor TBT® (0.16 g/m$^2$) coated from 1-butanol; and 2) a slipping layer of Emralon 329® (Acheson Colloids Co.), a dry film lubricant of polytetrafluoroethylene particles in a cellulose nitrate resin binder (0.54 g/m$^2$) and S-nauba micronized carnauba wax (0.016 g/m$^2$) coated from a n-propyl acetate, toluene, isopropyl alcohol and n-butyl alcohol solvent mixture.

TABLE 1

| Dye | Dye Coverage (g/m$^2$) | Binder Coverage (g/m$^2$) |
|---|---|---|
| C-2 | 0.36 | 0.71 |
| M-2 | 0.16 | 0.17 |

TABLE 1-continued

| Dye | Dye Coverage (g/m$^2$) | Binder Coverage (g/m$^2$) |
|---|---|---|
| Y-2 | 0.15 | 0.20 |
| P-1 | 0.42 | 0.55 |
| P-2 | 0.14 | 0.15 |
| P-3 | 0.28 | 0.37 |

Preparation and Evaluation of Thermal Dye Transfer Images

Thermal dye transfer images were prepared from the above dye-donor elements and Kodak Xtralife® dye-receiver. The dye side of a dye-donor element approximately 10 cm×15 cm in area was placed in contact with the receiving-layer side of a dye-receiving element of the same area. This assemblage was clamped to a stepper motor-driven, 60 mm diameter rubber roller. A thermal head (TDK No. 8I0625, thermostatted at 31° C.) was pressed with a force of 24.4 Newton (2.5 kg) against the dye-donor element side of the assemblage, pushing it against the rubber roller.

The imaging electronics were activated causing the donor-receiver assemblage to be drawn through the printing head/roller nip at 11.1 mm/sec. Coincidentally, the resistive elements in the thermal print head were pulsed (128 μsec/pulse) at 129 μsec intervals during a 4.1 msec /dot printing cycle. An image consisting of six large patches of varying density (approximately 0.3–2.3) was generated by appropriately varying the number of pulses/dot from a minimum of 0 to a maximum of 32 pulses/dot. The voltage supplied to the thermal head was approximately 12.8 v resulting in an instantaneous peak power of 0.321 watts/dot and a maximum total energy of 1.31 mJ/dot.

After printing, the dye-donor element was separated from the imaged receiving element and the spectral absorption curve of each patch was measured using a MacBeth Model 2145 Reflection Spectrophotometer having a Xenon pulsed source and a 10 mm nominal aperture. Reflectance measurements were made over the wavelength range of 380–750 nanometer using a measurement geometry of 45/0.

FIG. 1 shows the calculated characteristic vectors (normalized spectral transmission density vs. wavelength) that best represent the measured reflectance data for the transferred cyan, magenta and yellow image dyes, C-1, M-1 and Y-1, of Dye Set A over the entire density range.

Figure 2:
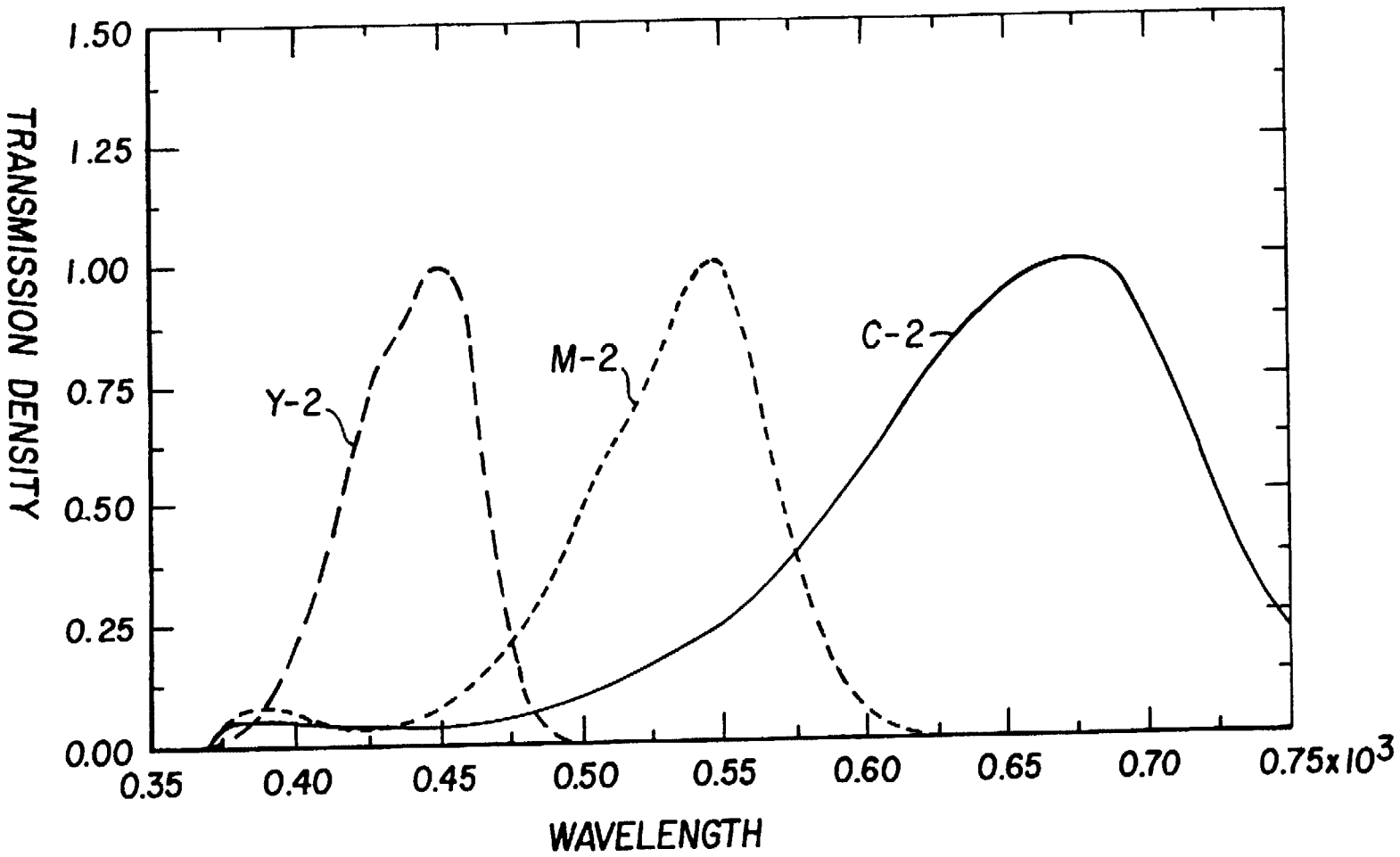
FIG. 2 is a plot of normalized spectral transmission density vs. wavelength of transferred yellow, magenta and cyan image dyes for a Dye Set B.

FIG. 2 shows the calculated characteristic vectors (normalized spectral transmission density vs. wavelength) that best represent the measured reflectance data for the transferred cyan, magenta and yellow image dyes, C-2, M-2 and Y-2, of Dye Set B over the entire density range.

Figure 3:
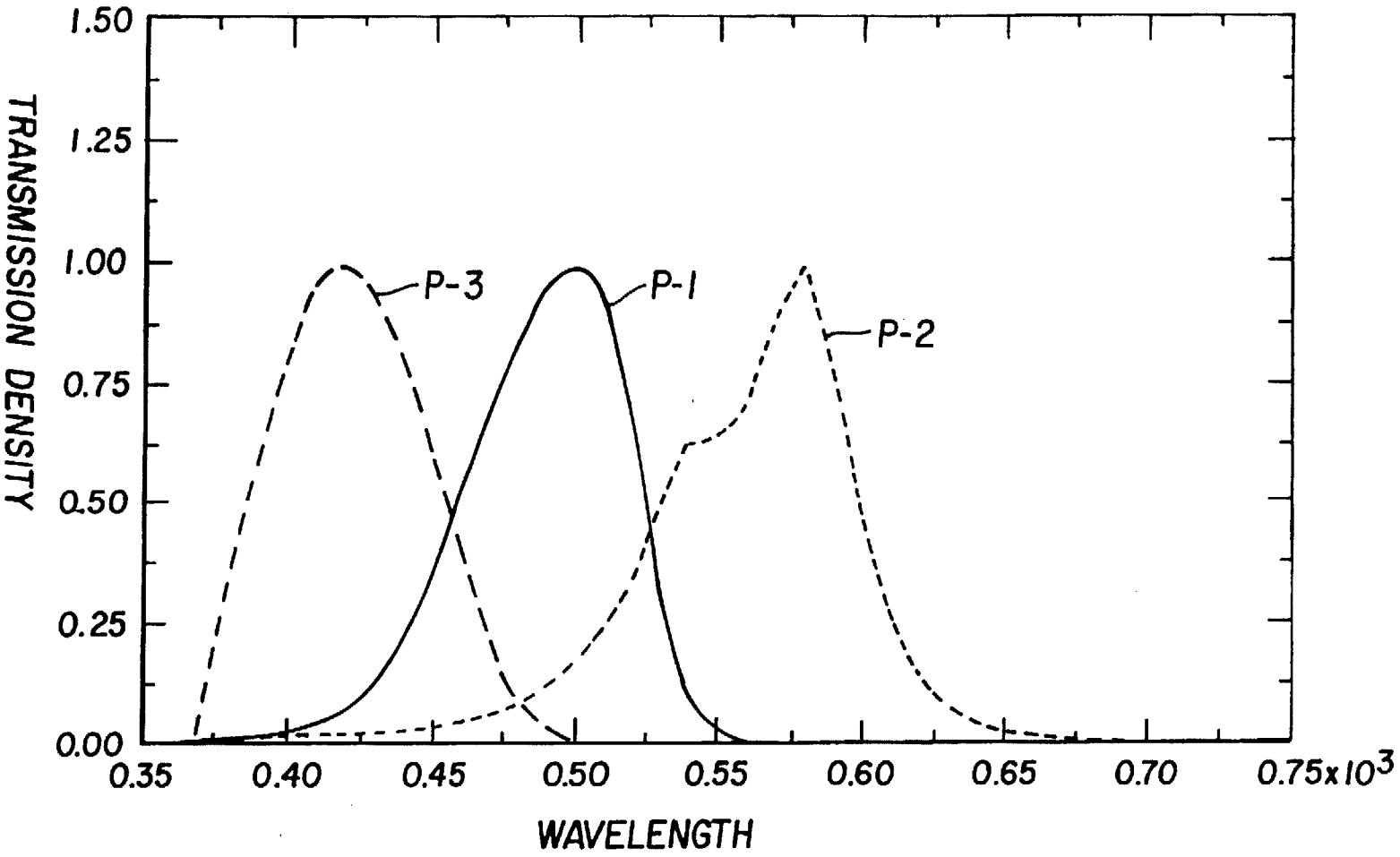
FIG. 3 is a plot of normalized spectral transmission density vs. wavelength for transferred image dyes P-1, P-2 and P-3.

FIG. 3 shows the calculated characteristic vectors (normalized spectral transmission density vs. wavelength) that best represent the measured reflectance data for the transferred additional image dyes P-1, P-2 and P-3 over the entire density range.

The D-max curve for each image dye was obtained from its characteristic vector. The characteristic vector for each image dye was scaled in transmission space so that when converted to reflectance and added to the D-min curve of the reflection receiver, a reflection density of 2.5 at the λ-max of the transferred dye would be obtained. Black dye mixtures were similarly devised by adding together the subtractive-primary characteristic vectors of each dye set (A and B) so that when converted to reflectance and added to the D-min curve of the reflection receiver, a visually neutral (a*=b*=0) transferred image with a reflection density of 2.5 at the λ-max of the peak absorption of the composite dye mixture would be obtained. After conversion back to reflectance, the corresponding CIELAB coordinates at the D-max of each image dye and black mixture were calculated using a D5000 illuminant and shown in Table 2.

TABLE 2

| Dye(s) | λ-max | L* | a* | b* |
|---|---|---|---|---|
| C-1 | 680 nm | 54.2 | −37.5 | −44.3 |
| M-1 | 540 | 31.2 | 71.5 | −26.8 |
| Y-1 | 460 | 80.2 | 16.9 | 102.6 |
| C-2 | 680 | 41.3 | −11.0 | −55.7 |
| M-2 | 550 | 49.6 | 86.7 | −21.3 |
| Y-2 | 450 | 93.7 | −17.1 | 87.1 |
| P-1 | 500 | 79.1 | 38.2 | 70.2 |
| P-2 | 580 | 36.1 | 64.4 | −67.2 |
| P-3 | 420 | 94.2 | −16.0 | 87.3 |
| B-1 (C-1/M-1/Y-1) | 680[2] | 8.7 | 0 | 0 |
| B-2 (C-2/M-2/Y-2) | 450[2] | 15.5 | 0 | 0 |

[1]Calculated at a reflection density of 2.5 (measured at the λ-max of the transferred dye).
[2]λ-max of the highest peak in the composite spectrum.

The color coordinates of each of the image dyes from Table 2 at maximum transferred density were then compared to the closest calculated point (at the same L* value) in color space achievable with a linear combination of the dyes of Dye Sets A or B. The differences ($\Delta E_c$) are tabulated in Table 3.

TABLE 3

CIELAB $\Delta E_c$ Values Between Image Dyes (at D-max) and Basis Dye Set Gamuts at Equal L* Values

| Image Dye | $\Delta E_c$ (Set A) | $\Delta E_c$ (Set B) | $\Delta E_c$ (Set C) | $\Delta E_c$ (Set D) |
|---|---|---|---|---|
| P-1 | 22 | 21 | 22 | 21 |
| P-2 | 30 | 17 | 30 | 17 |
| P-3 | 65 | 10 | 65 | 10 |
| C-1 | ≦0[a] | 14 | ≦0[a] | 14 |
| M-1 | ≦0[a] | 17 | ≦0[a] | 17 |
| Y-1 | ≦0[a] | 29 | ≦0[a] | 29 |
| C-2 | 6 | ≦0[a] | 6 | ≦0[a] |
| M-2 | 25 | ≦0[a] | 25 | ≦0[a] |
| Y-2 | 58 | ≦0[a] | 58 | ≦0[a] |
| B-1 | 4 | 10 | ≦0[a] | ≦0[a] |
| B-2 | ≦0[a] | 1 | ≦0[a] | ≦0[a] |

superscript [a] indicates color is on or within the gamut boundaries

The above results show that the color coordinates of transferred P-1, P-2 and P-3 dyes are all >5 CIELAB units outside of the gamut of all basis dye sets. The image dyes of Dye Set A are all outside (>5 CIELAB units) of the gamut defined by Dye Sets B and D and the image dyes of Dye Set B are outside of the gamut defined by Dye Sets A and C.

Black Dye Mixture B-1 is outside of the gamut defined by Dye Set B; however Black Mixture B-2 is within the gamut of Dye Set A.

The color gamuts of various 3-, 4-, 5- and 6-dye systems were then calculated as described above and the results listed in Table 4. The relative color gamut determined by dividing the gamut of a given dye set by the gamut of the appropriate basis set is also listed to make comparisons easier.

The color coordinates of the color samples in the Pantone® Color Formula Guide were measured and compared with the calculated color gamuts. The number of Pantone® colors that are within each of the calculated color gamuts also listed in Table 4.

TABLE 4

| Dye Set | Basis Dye Set | Additional Dye(s) | Calculated Color Gamut Relative[1] | Calculated Color Gamut Absolute | Number of Pantone colors |
|---|---|---|---|---|---|
| CONTROL DYE SETS | | | | | |
| 1 | A | none | 1.00 | 53,800 | 592 |
| 2 | A | C-1 | 1.12 | 60,200 | 650 |
| 3 | A | M-1 | 1.03 | 55,600 | 592 |
| 4 | A | Y-1 | 1.12 | 60,100 | 604 |
| 5 | A | B-1 | 1.09 | 58,700 | 623 |
| 6 | A | B-2 | 1.09 | 58,900 | 625 |
| INVENTION DYE SETS | | | | | |
| 7 | A | C-2 | 1.14 | 61,300 | 652 |
| 8 | A | M-2 | 1.24 | 67,000 | 701 |
| 9 | A | Y-2 | 1.28 | 68,700 | 670 |
| 10 | A | P-1 | 1.21 | 65,300 | 663 |
| 11 | A | P-2 | 1.27 | 68,200 | 685 |
| 12 | A | P-3 | 1.28 | 68,900 | 672 |
| 13 | A | P-1, P-2 | 1.48 | 79,700 | 756 |
| 14 | A | P-1, P-3 | 1.49 | 80,400 | 739 |
| 15 | A | P-2, P-3 | 1.59 | 85.500 | 759 |
| 16 | A | C-2, M-2 | 1.38 | 74,300 | 756 |
| 17 | A | C-2, Y-2 | 1.45 | 77,900 | 718 |
| 18 | A | M-2, Y-2 | 1.54 | 82,700 | 781 |
| 19 | A | C-2, M-2, Y-2 | 1.71 | 91,900 | 824 |
| 20 | A | P-1, P-2, P-3 | 1.80 | 96,800 | 826 |
| CONTROL DYE SETS | | | | | |
| 21 | B | none | 1.00 | 51,700 | 599 |
| 22 | B | C-2 | 1.08 | 55,500 | 621 |
| 23 | B | M-2 | 1.10 | 56,700 | 617 |
| 24 | B | Y-2 | 1.11 | 57,400 | 639 |
| 25 | B | B-2 | 1.10 | 56,700 | 632 |
| INVENTION DYE SETS | | | | | |
| 26 | B | C-1 | 1.20 | 62,100 | 669 |
| 27 | B | M-1 | 1.16 | 60,000 | 629 |
| 28 | B | Y-1 | 1.38 | 71,200 | 732 |
| 29 | B | B-1 | 1.17 | 60,400 | 655 |
| 30 | B | P-1 | 1.49 | 77,100 | 782 |
| 31 | B | P-2 | 1.25 | 64,500 | 650 |
| 32 | B | P-3 | 1.13 | 58,700 | 645 |
| 33 | B | P-1, P-2 | 1.77 | 91,300 | 825 |
| 34 | B | P-1, P-3 | 1.59 | 82,016 | 797 |
| 35 | B | P-2, P-3 | 1.41 | 73,100 | 700 |
| 36 | B | C-1, M-1 | 1.36 | 70,200 | 699 |
| 37 | B | C-1, Y-1 | 1.65 | 85,400 | 812 |
| 38 | B | M-1, Y-1 | 1.52 | 78,400 | 751 |
| 39 | B | C-1, M-1, | 1.78 | 91,900 | 824 |
| 40 | B | P-1, P-2, P-3 | 1.88 | 96,900 | 838 |
| CONTROL DYE SETS | | | | | |
| 41 | C | none | 1.0 | 58,700 | 623 |
| 42 | C | C-1 | 1.08 | 63,400 | 657 |
| 43 | C | M-1 | 1.02 | 60,000 | 623 |
| 44 | C | Y-1 | 1.08 | 63,700 | 630 |
| INVENTION DYE SETS | | | | | |
| 45 | C | C-2 | 1.09 | 64,000 | 657 |
| 46 | C | M-2 | 1.22 | 71,600 | 732 |
| 47 | C | Y-2 | 1.23 | 72,000 | 681 |
| 48 | C | P-1 | 1.17 | 69,000 | 689 |
| 49 | C | P-2 | 1.20 | 70,600 | 692 |
| 50 | C | P-3 | 1.23 | 72,200 | 683 |
| CONTROL DYE SETS | | | | | |
| 51 | D | none | 1.0 | 56,700 | 632 |
| 52 | D | C-2 | 1.04 | 59,200 | 642 |
| 53 | D | M-2 | 1.07 | 60,700 | 641 |

TABLE 4-continued

| Dye Set | Basis Dye Set | Additional Dye(s) | Calculated Color Gamut Relative[1] | Calculated Color Gamut Absolute | Number of Pantone colors |
|---|---|---|---|---|---|
| 54 | D | Y-2 | 1.09 | 61,600 | 661 |
| INVENTION DYE SETS | | | | | |
| 55 | D | C-1 | 1.16 | 66,000 | 689 |
| 56 | D | M-1 | 1.10 | 62,300 | 642 |
| 57 | D | Y-1 | 1.31 | 74,400 | 748 |
| 58 | D | P-1 | 1.42 | 80,300 | 797 |
| 59 | D | P-2 | 1.20 | 67,800 | 666 |
| 60 | D | P-3 | 1.11 | 62,900 | 670 |

[1]Ratio of the color gamut of the dye set in question to the appropriate 3- or 4-dye basis dye set.

The above data show that whenever one or more additional image dye-donors are used in combination with a 3(CMY)- or 4(CMYB)-dye basis set, large increases in the color gamut of the transferred dye set are realized whenever the additional dye-donors yield transferred dye images which have CIELAB color coordinates more than 5 $\Delta E_c$ units outside of the color gamut of the basis set. The gamut increases when the additional image dye-donors chosen according to the invention are larger than when additional image dye-donors are used that do not yield transferred dye images which have CIELAB color coordinates more than 5 $\Delta E_c$ units outside of the color gamut of the basis set.

Thus, referring to the results in Table 4 for Dye Sets 1–20, using additional image dye-donors containing dyes C-1, M-1, Y-1, B-1 or B-2 (Dye Sets 2–6) along with basis set A produces only small increases in color gamut (relative color gamut values of 1.03–1.12). As is shown in Table 3, these image dye-donors do not yield transferred dye images which have CIELAB color coordinates more than 5 $\Delta E_c$ units outside of the color gamut of Dye Set A.

On the other hand, using additional image dye-donors containing dyes C-2, M-2, Y-2, P-1, P-2 or P-3 (Dye Sets 7–12) along with basis set A produces much larger increases in color gamut (relative color gamut values of 1.14–1.28). As is shown in Table 3, these image dye-donors do yield transferred dye images which have CIELAB color coordinates more than 5 $\Delta E_c$ units outside of the color gamut of Dye Set A.

Similarly, the number of Pantone colors that can be reproduced with Dye Sets 7–12 of the invention, 652–701, is larger than can be reproduced with control Dye Sets 2–6, 592–650, (see Table 4).

As is also shown in Table 4, using two or three additional image dye-donors chosen according to the invention, Dye Sets 13–20, yields even larger increases in color gamut, relative color gamut values of 1.38–1.80, and the number of Pantone colors that can be reproduced, 718–826.

Similar analysis of the data in Table 4 which shows the effect of using additional image dye-donors along with basis dye sets B, C and D (see Dye Sets 21–60) also illustrates the invention.

Figure 4:
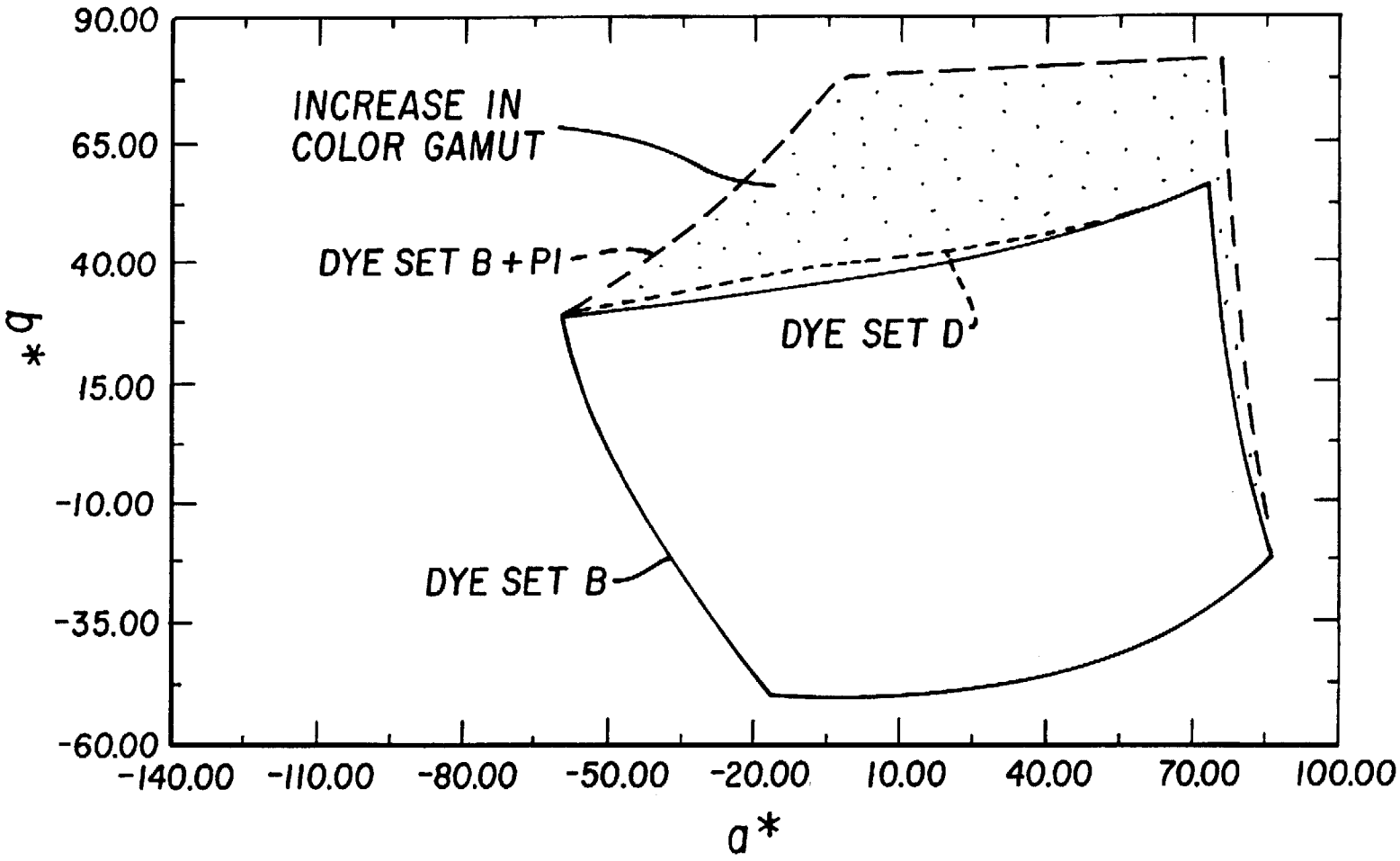
FIG. 4 is a plot of color gamuts of Dye Sets B, D and B+P-1 at L* =50.

FIG. 4 compares the calculated color gamuts of Dye Set B, Dye Set D and Dye Set B plus additional image dye P-1, at an L*=50. The plot shows that there is a very small increase in color gamut when a black dye is added to Dye Set B. However, when dye P-1 is added to Dye Set B in accordance with the invention, a large invention, a large increase in color gamut is realized, as shown by the dotted area.

The invention has been described in detail with particular reference to preferred embodiments thereof, but it will be understood that variations and modifications can be effected within the spirit and scope of the invention.

What is claimed is:

1. A multicolor dye-donor element for thermal dye transfer capable of producing improved color gamut comprising a support having thereon a set of sequential repeating dye patches of yellow, magenta and cyan image dyes dispersed in a polymeric binder, said element also having at least one additional dye patch comprising a dye dispersed in a polymeric binder, the dye of each said additional dye patch which, when transferred to a dye image-receiving layer before or after transfer of said yellow, magenta and cyan image dyes, has a hue measured at its maximum density which is outside the color gamut defined by the hues of said transferred yellow, magenta and cyan image dyes by more than 5 CIELAB $\Delta E_c$ units.

2. The element of claim 1 wherein said set of sequential repeating dye patches contains an additional dye patch comprising a black image dye dispersed in a polymeric binder.

3. The element of claim 1 wherein the dye of each said additional dye patch which, when transferred to a dye image-receiving layer before or after transfer of said yellow, magenta and cyan image dyes, has a hue measured at its maximum density which is outside the color gamut defined by the hues of said transferred yellow, magenta and cyan image dyes by more than 10 CIELAB $\Delta E_c$ units.

4. The element of claim 1 wherein said support comprises poly(ethylene terephthalate) and the side of the support opposite the side having thereon said dye patches is coated with a slipping layer comprising a lubricating material.

5. A process of forming a dye transfer image comprising imagewise-heating a dye-donor element comprising a support having thereon a dye layer comprising a dye dispersed in a polymeric binder and transferring a dye image to a dye image-receiving layer of a dye-receiving element to form said dye transfer image, wherein said dye-donor element comprises a support having thereon a set of sequential repeating dye patches of yellow, magenta and cyan image dyes dispersed in a polymeric binder, said dye-donor element also having at least one additional dye patch comprising a dye dispersed in a polymeric binder, the dye of each said additional dye patch which, when transferred to said dye image-receiving layer before or after transfer of said yellow, magenta and cyan image dyes, has a hue measured at its maximum density which is outside the color gamut defined by the hues of said transferred yellow, magenta and cyan image dyes by more than 5 CIELAB $\Delta E_c$ units.

6. The process of claim 5 wherein said set of sequential repeating dye patches contains an additional dye patch comprising a black image dye dispersed in a polymeric binder.

7. The process of claim 5 wherein the dye of each said additional dye patch which, when transferred to a dye image-receiving layer before or after transfer of said yellow, magenta and cyan image dyes, has a hue measured at its maximum density which is outside the color gamut defined by the hues of said transferred yellow, magenta and cyan image dyes by more than 10 CIELAB $\Delta E_c$ units.

8. A process of forming a dye transfer image comprising imagewise-heating a dye-donor element comprising a support having thereon a dye layer comprising a dye dispersed in a polymeric binder and transferring a dye image to a dye image-receiving layer of a dye-receiving element to form said dye transfer image, wherein separate dye-donor elements are employed comprising supports having thereon yellow, magenta and cyan image dye layers and at least one additional dye layer comprising an image dye dispersed in a polymeric binder, the dye of each said additional dye layer which, when transferred to said dye image-receiving layer before or after transfer of said yellow, magenta and cyan image dyes, has a hue measured at its maximum density which is outside the color gamut defined by the hues of said transferred yellow, magenta and cyan image dyes by more than 5 CIELAB $\Delta E_c$ units.

9. The process of claim 8 wherein said separate dye-donor elements comprise supports having thereon yellow, magenta, cyan and black image dye layers.

10. The process of claim 8 wherein the dye of each said additional dye patch which, when transferred to a dye image-receiving layer before or after transfer of said yellow, magenta and cyan image dyes, has a hue measured at its maximum density which is outside the color gamut defined by the hues of said transferred yellow, magenta and cyan image dyes by more than 10 CIELAB $\Delta E_c$ units.

11. A thermal dye transfer assemblage comprising:

I) a dye-donor element comprising a support having thereon a dye layer comprising an image dye dispersed in a polymeric binder, and II) a dye-receiving element comprising a support having thereon a dye image-receiving layer, said dye-receiving element being in superposed relationship with said dye-donor element so that said dye layer is in contact with said dye image-receiving layer, wherein said dye-donor element comprises a support having thereon a set of sequential repeating dye patches of yellow, magenta and cyan image dyes dispersed in a polymeric binder, said dye-donor element also having at least one additional dye patch comprising a dye dispersed in a polymeric binder, the dye of each said additional dye patch which, when transferred to said dye image-receiving layer before or after transfer of said yellow, magenta and cyan image dyes, has a hue measured at its maximum density which is outside the color gamut defined by the hues of said transferred yellow, magenta and cyan image dyes by more than 5 CIELAB $\Delta E_c$ units.

12. The assemblage of claim 11 wherein said set of sequential repeating dye patches contains an additional dye patch comprising a black image dye dispersed in a polymeric binder.

13. The assemblage of claim 11 wherein the dye of each said additional dye patch which, when transferred to said dye image-receiving layer before or after transfer of said yellow, magenta and cyan image dyes, has a hue measured at its maximum density which is outside the color gamut defined by the hues of said transferred yellow, magenta and cyan image dyes by more than 10 CIELAB $\Delta E_c$ units.

* * * * *